US008232929B2

(12) United States Patent
Ineichen et al.

(10) Patent No.: US 8,232,929 B2
(45) Date of Patent: Jul. 31, 2012

(54) MICROWAVE ANTENNA FOR WIRELESS NETWORKING OF DEVICES IN AUTOMATION TECHNOLOGY

(75) Inventors: Alois Ineichen, Ruswil (CH); Thorsten Godau, Suessen (DE)

(73) Assignee: Pilz GmbH & Co. KG, Ostfildern (DE)

( * ) Notice: Subject to any disclaimer, the term of this patent is extended or adjusted under 35 U.S.C. 154(b) by 0 days.

(21) Appl. No.: 12/786,801

(22) Filed: May 25, 2010

(65) Prior Publication Data

US 2011/0043432 A1 Feb. 24, 2011

Related U.S. Application Data

(63) Continuation of application No. PCT/EP2008/009688, filed on Nov. 15, 2008.

(30) Foreign Application Priority Data

Nov. 26, 2007 (DE) ..... 10 2007 058 257

(51) Int. Cl.
*H01Q 21/00* (2006.01)
*H01Q 3/00* (2006.01)
*H01Q 3/24* (2006.01)

(52) U.S. Cl. ..... 343/867; 343/765; 343/876; 343/866; 343/732

(58) Field of Classification Search ..... None
See application file for complete search history.

(56) References Cited

U.S. PATENT DOCUMENTS 5,640,170 A * 6/1997 Anderson ..... 343/895
5,914,862 A * 6/1999 Ferguson et al. ..... 361/737
6,317,101 B1 11/2001 Dockery
6,369,778 B1 4/2002 Dockery
7,362,285 B2 * 4/2008 Webb et al. ..... 343/866
2002/0089461 A1 * 7/2002 Mimura et al. ..... 343/742
2008/0018550 A1 * 1/2008 Horii ..... 343/867
2008/0136730 A1 * 6/2008 Chen ..... 343/867

FOREIGN PATENT DOCUMENTS

WO WO 02/23669 A1 3/2002

OTHER PUBLICATIONS

European Committee for Standardization, EN 954-1, Safety-related parts of control systems, Dec. 1996, 33 pages. European Committee for Standardization, EN ISO 13849-1, Safety of machinery—Safety-related parts of control systems—Part 1: General principles for design, Nov. 2006, 96 pages.
Phoenix Contact, Automationworx User Manual, Nov. 2005, 68 pages.
International Standard IEC 61508-2, Functional safety of electrical/electronic/programmable electronic safety-related systems, May 2000, 150 pages.
XP-002517692, Rothammel: "Rothammels Antennenbuch", 2001, p. 533.
http://davehouston.net/eggbeater.htm, Eggbeater Antenna, Nov. 20, 2007; 2 pages.

* cited by examiner

*Primary Examiner* — Trinh Dinh
(74) *Attorney, Agent, or Firm* — Harness, Dickey & Pierce, P.L.C.

(57) ABSTRACT

A microwave antenna for wireless interconnection of automation devices has a first printed circuit board, on which a first conductor loop is arranged as a printed conductor track. A second printed circuit board having a second conductor loop in the form of a printed conductor track is arranged transversely with respect to the first printed circuit board. The second printed circuit board is attached to the first printed circuit board. The conductor loops are connected to a common feed connection. A bypass line connects one end of each the first and the second conductor loops.

18 Claims, 4 Drawing Sheets

MICROWAVE ANTENNA FOR WIRELESS NETWORKING OF DEVICES IN AUTOMATION TECHNOLOGY

CROSS REFERENCES TO RELATED APPLICATIONS

This application is a continuation of international patent application PCT/EP2008/009688 filed on Nov. 15, 2008 designating the U.S., which international patent application has been published in German language and claims priority from German patent application DE 10 2007 058 257.0 filed on Nov. 26, 2007. The entire contents of these prior applications are incorporated herein by reference.

BACKGROUND OF THE INVENTION

The present invention relates to a microwave antenna for wireless interconnection of automation devices, and in particular for networking of remote sensors, actuators and a central control unit in an automated installation.

For many years, there has been an increasing desire to automate the process procedures for the industrial production of products. This is leading to increasing networking of devices and components which are involved in the production processes. Typically, these are sensors for detection of installation or process states, actuators which cause a change in the installation or process states, and control units for producing control signals by means of which the actuators are controlled as a function of the sensor signals. In small installations, the sensors and actuators can be connected directly to the control unit. In larger and extended installations, which require a large number of sensors and actuators, communication networks have already been in use for many years, in order to network the sensors, actuators and control units to one another. A typical example of such communication networks is so-called fieldbuses. These are communication networks which are matched to the specific requirements for applications such as these, in particular with respect to the severe environmental conditions and the typical communication requirement between control units and remote sensors and actuators. Known fieldbuses are the so-called Profibus, the so-called Interbus and the so-called CAN bus. These fieldbuses typically use electrical and/or optical lines for networking the connected devices.

For some years, efforts have also been made to implement the networking of automation devices on the basis of the known Ethernet Standard, which has come into use for the networking of personal computers in home and office applications. In this context, there are also efforts to implement the connection between the devices wirelessly as is already frequently the case with the aid of WLAN in home and office networks. However, the home and office network technology cannot be transferred directly to industrial production environment applications, because the communication requirement and the environmental conditions are different. Typically, there are a large number of metallic objects and moving objects in factory workshops, which can severely influence the propagation of radio waves. On the other hand, the communication between the control units and the sensors and actuators frequently has to take place at very short, cyclically recurring, time intervals, in order to allow a continuous production process, without any disturbances. Furthermore, the requirements for the reliability of the communication link are more stringent when safety-relevant data is intended to be transmitted, on which the operating safety of an automated installation depends. For example, many production installations carry out dangerous movements which must be stopped immediately when an operator approaches the installation. In a situation such as this, the signal from a light barrier which detects the person must be transmitted quickly to the central control unit, and the switch-off command must reach the correct drive in the installation within a defined and guaranteed time period. This is typically in the region of fractions of seconds, in contrast to home and office networks.

There are a plurality of antenna types and shapes for various applications in the field of automation technology as well as in the fields of satellite communication, mobile radio, position-finding, etc. One specific example suggested in amateur radio is what is called an "eggbeater antenna". This antenna has two circular conductor loops whose ends are connected via a bypass line, with the length of the bypass line corresponding to approximately one quarter of the wavelength of the radio signals to be received. The two conductor loops are connected to a common feed point, at which the antenna signals can be input or output. The antenna is supposed to have a good omnidirectional radiation characteristic. However, it is not suitable for the severe environmental conditions in an industrial production installation.

SUMMARY OF THE INVENTION

Against this background, it is an object of the present invention to provide a low-cost microwave antenna for wireless networking of automation devices.

It is another object to provide a microwave antenna which can be flexibly used and allows stable radio transmissions in the severe transmission conditions of an industrial environment.

According to one aspect of the invention, there is provided a microwave antenna for wireless interconnection of remote sensors, remote actuators and a central control unit of an automated installation, the microwave antenna being designed for transmitting or receiving radio signals having a defined wavelength and the antenna comprising a first circuit board having a front face and a rear face, a first rectangular conductor track arranged approximately half on the front face and half on the rear face, said first conductor track forming a first conductor loop having a first end on the front face and a second end on the rear face, a second printed circuit board transversely attached to the first printed circuit board, a second rectangular conductor track arranged on the second circuit board and forming a second conductor loop having a third end and a fourth end, a coaxial connector secured to the first printed circuit board, the coaxial connector comprising an inner conductor and an outer conductor, a solder connection conductively connecting the first end and the third end, a bypass line having a length corresponding to approximately one quarter of the wavelength, the bypass line conductively connecting the second end and the fourth end, and a front conductor track on the front face and a rear-face conductor track on the rear face, wherein the front conductor track is configured to conductively connect the outer conductor and the first end, and wherein the rear-face conductor track is configured to conductively connect the inner conductor and the second end.

According to another aspect, there is provided a microwave antenna for wireless interconnection of remote devices of an automated installation, the microwave antenna being designed for transmitting or receiving radio signals having a defined wavelength and the antenna comprising a first printed circuit board comprising a first conductor loop having a first end and a second end and comprising a second conductor loop having a third end and a fourth end, the first printed circuit board defining a plane in which the first and second conductor loops are offset with respect to one another in two orthogonal directions, a second printed circuit board transversely attached to the first printed circuit board in the vicinity of the first conductor loop, the second printed circuit board comprising a third conductor loop which is conductively connected to the first conductor loop via a bypass line having a length corresponding to approximately one quarter of the wavelength, a third printed circuit board transversely attached to the first printed circuit board in the vicinity of the second conductor loop, the third printed circuit board comprising a fourth conductor loop which is conductively connected to the second conductor loop via a further bypass line having a length corresponding to approximately one quarter of the wavelength, a coaxial connector secured to the first printed circuit board, and an antenna switching unit integrated on the first printed circuit board and designed to alternatively connect the coaxial connector to either the first conductor loop or the second conductor loop.

According to yet another aspect, there is provided a microwave antenna for wireless networking of automation devices, the microwave antenna being designed for transmitting or receiving radio signals having a wavelength and comprising a first printed circuit board, on which a first conductor loop is arranged as a printed conductor track, the first conductor loop having a first end and a second end, a second printed circuit board, on which a second conductor loop is arranged as a printed conductor track, the second conductor loop having a third end and a fourth end, and the second printed circuit board being arranged transversely with respect to the first printed circuit board, a common feed connection arranged on the first printed circuit board for feeding the first and second conductor loops at the first and third ends, and a bypass line having a length corresponding to approximately one quarter of the wavelength of the radio signals, the bypass line conductively connecting the second end and the fourth end.

The novel microwave antenna uses (at least) two conductor loops which are arranged transversely with respect to one another, which are connected via a bypass line, and which have a common feed point. In contrast to the known eggbeater antenna, the two conductor loops are in this case in the form of printed conductor tracks. The term "printed conductor track" in this context means conductive (in particular metallic) tracks, which are arranged in a fixed form as thin layers on a mounting board composed of an insulating material. In preferred exemplary embodiments, the printed circuit boards are composed of a glass fiber fabric which is bonded using epoxy resin (so-called FR4 printed circuit boards). Alternatively, the printed circuit boards may be composed of PTFE, ceramic or other insulating plastic and/or composite materials, for example of Rexolite® 1422 or Noryl. In preferred exemplary embodiments, the conductor tracks are composed of copper, which has been deposited on the boards by suitable coating methods. In principle, production methods are used in this case that are the same as those used for production of printed circuit boards for other purposes, for example printed circuit boards for population with electrical and/or electronic components.

The novel microwave antenna has (at least) two printed circuit boards, which are arranged transversely with respect to one another. In preferred exemplary embodiments, the novel microwave antenna has two printed circuit boards which are arranged at right angles to one another. The second printed circuit board will preferably have been attached retrospectively to the first printed circuit board, that is to say after the conductor tracks have been produced on the separate printed circuit boards. However, in principle, the "crossed-over" printed circuit boards could also be produced before the production of the conductor tracks.

In all cases, the first printed circuit board carries not only the first conductor loop, but also the second printed circuit board with the second conductor loop, and advantageously also the feed connection and the bypass line, such that the second printed circuit board complements the first printed circuit board to form the novel microwave antenna. Basically, the first printed circuit board including the first conductor loop could actually be used as a microwave antenna on its own. However, the addition of the second printed circuit board results in the novel microwave antenna having an overall radiation characteristic which is virtually optimum for wireless networking of devices in industrial working environments. Together, the two conductor loops produce a horizontal radiation characteristic, which is nearly optimally circular for horizontal polarization. To a good approximation, it also has a circular radiation characteristic on the horizontal plane for vertical polarization. Furthermore, the novel antenna also has an omnidirectional radiation characteristic on the vertical plane to a good approximation for both horizontal polarization and vertical polarization. Initially, this appears to be surprising if one considers that the conductor loops are themselves horizontally polarized. However, because of the bypass line, the two conductor loops are operated with a phase shift which, in the preferred exemplary embodiments, is about 90° ($\lambda/4$ bypass line). This phase shift results in circular polarization, that is to say rotating polarization, which includes vertical polarization components.

The novel microwave antenna therefore allows good reception and good transmission in virtually all spatial directions and on all polarization planes. As a consequence of this, the novel microwave antenna can be used very flexibly and largely without any specific planning and installation work.

Furthermore, the universal transmission and reception characteristics of the novel microwave antenna are of major advantage for use in industrial working environments, such as factory workshops, in which moving machines and numerous other metallic structures occur. Many of these structures have vertical edges, which is disadvantageous for transmission with vertical polarization. Vertical polarization is also rather disadvantageous for penetration of walls. However, vertical polarization has advantages for communication between different floors. The novel microwave antenna can be operated largely independently of the environmental conditions at the point of use, because it operates both with horizontal and vertical polarization. In contrast, conventional rod antennas are optimum for only one of the two types of polarization.

Furthermore, the novel microwave antenna can be produced very easily and with tight tolerances because of the printed circuit board technology, and it is very robust, compact and stable. It is therefore suitable for use in severe industrial environments. In addition, it can be produced at low cost in large quantities, as are typically required for a purpose such as this.

A further advantage of the novel microwave antenna is that the various polarizations can be used for decoupling from other radio services. For example, traditional WLAN radio networks and Bluetooth generally operate with vertical polarization, as a result of which the good transmission and reception characteristics of the novel antenna for horizontal polarization lead to the expectation of less interference from radio networks such as these. Nevertheless, the novel antenna is compatible with the conventional systems.

In a preferred refinement, at least one of the printed circuit boards has a slot, into which the other printed circuit board is inserted. In preferred exemplary embodiments, the first and the second printed circuit board each have a slot, and the slots are plugged into one another. Furthermore, it is preferable for the slot in the second printed circuit board to be very long in comparison to the slot in the first printed circuit board, as a result of which the second printed circuit board is largely seated "on" the first printed circuit board.

These refinements allow the novel microwave antenna to be assembled very easily, at low cost, and to be robust. The two printed circuit boards can be produced separately, using conventional technology. The second printed circuit board is then plugged onto the first printed circuit board. The slots allow the conductor loops to be positioned at substantially the same height. A long slot in the second printed circuit board makes it possible for the two conductor loops to be closed, with the exception of the respective ends. Such largely closed conductor loops simplify the preferred omnidirectional radiation characteristic of the novel antenna.

In a further refinement, at least one first metal surface is arranged on the first printed circuit board, and at least one second metal surface is arranged on the second printed circuit board, wherein the first and second metal surfaces are isolated from the conductor loops and are soldered to one another. The first and second metal surfaces are preferably soldered directly to one another, that is to say the solder tin connects the metal surfaces directly, and without any additional metal pins or the like.

This refinement ensures that the novel microwave antenna is highly robust, and reduces the load on the electrical solder connections between the conductor loops. On the other hand, the metal surfaces can be produced very easily and at low cost together with the conductor loops, and the soldering of the metal surfaces is also simple and costs little.

In a further refinement, at least one of the metal surfaces is a plated-through double surface, which has a front metal surface on a front face of the printed circuit board, and a rear-face metal surface on a rear face of the printed circuit board.

In this refinement, at least one of the metal surfaces is arranged both on the front face and on the rear face of the respective printed circuit board. This allows multiple solder connections and, as a consequence of this, a very robust connection between the printed circuit boards, in a very simple and low-cost manner. The plating-through prevents the opposite metal surfaces on the front face and the rear face acting as a plate capacitor. In consequence, the plated-through areas contribute to the good antenna characteristic.

In a further refinement, the bypass line is a printed conductor track, which is arranged on the first printed circuit board. The bypass line is preferably a stripline which produces a 90° phase shift and is soldered to the fourth end (on the second printed circuit board).

This refinement allows the bypass line to be produced very easily and at low cost.

In a further refinement, the first and the third ends are soldered without a bypass line.

In this refinement, the bypass line connects only one respective end of the two conductor loops, while the respective other ends are directly connected. An electrically short conductor piece may be provided for connection of the other ends, in order to compensate for height and/or position differences. The novel microwave antenna in this refinement differs from the eggbeater antenna mentioned initially in the electrical connection of the four conductor ends. Therefore, it can be assumed that this refinement advantageously contributes to the highly uniform omnidirectional radiation characteristic which the exemplary embodiments described in the following text have.

In a further refinement, the novel microwave antenna has a further printed conductor track, which is arranged on the first printed circuit board and conductively connects the feed connection and the first end.

In this refinement, the first printed circuit board is the main printed circuit board, on which all the major antenna elements (preferably including the bypass line) are arranged. It is then sufficient for the second printed circuit board to have the second conductor loop and isolated metal surfaces for mechanical attachment. This refinement allows very low-cost production, since the second printed circuit board can be used for different types of the novel microwave antenna, as will be explained in the following text with reference to preferred exemplary embodiments. Furthermore, this refinement makes it easier to mount the second printed circuit board on the first printed circuit board.

In a further refinement, the further printed conductor track has a front conductor track on a front face of the first printed circuit board, and a rear-face conductor track on a rear face of the first printed circuit board, wherein the feed connection is a coaxial connection with an inner conductor and an outer conductor, wherein the front conductor track conductively connects the outer conductor and the first end, and wherein the rear-face conductor track conductively connects the inner conductor and the second end. The front conductor track and the rear-face conductor track are preferably arranged one above the other, as a result of which they form a largely symmetrical stripline.

This refinement also contributes to low-cost production of the novel microwave antenna. The line connection between the feed connection and the conductor loops is in this case integrated on the first printed circuit board, in a low-cost manner.

In a further refinement, the front conductor track is a wide conductor track in the area of the feed connection, and it tapers symmetrically toward the first end. In one preferred exemplary embodiment, the front conductor track tapers with a radius of about $\lambda/6$, where $\lambda$ is the wavelength of the antenna radiation. The rear-face conductor track preferably has a largely constant width.

In this refinement, the further conductor tracks form a so-called balun. This balun is a very simple, low-cost option, which can be reproduced with high accuracy, for matching a conventional, coaxial feed connection to the conductor loops of the novel antenna.

In a further refinement, the first conductor loop is arranged approximately half on the front face and approximately half on the rear face of the first printed circuit board.

This refinement allows very simple and efficient connection of the conductor loops to the feed line.

In a further refinement, the conductor loops are rectangular, in particular square. Preferably, the edge length of the square conductor loops is approximately $\lambda/4$. In other exemplary embodiments, the conductor loops are rectangular with an aspect ratio of 2:1. In this case as well, the overall length of the conductor loops is preferably substantially equal to the wavelength of the transmitted and received signals.

In principle, the conductor loops could also be circular, elliptical or could have some other shape. However, it has been found that rectangular, and in particular square, conductor loops significantly contribute to the good antenna characteristic of the novel microwave antenna. This is possibly due to the fact that the corners of the conductor loops cause radiation contributions which lead to advantageous interference.

In a further refinement, the conductor loops run at the edge of the printed circuit boards. It is particularly advantageous for the printed circuit boards also to have recesses, such that the conductor loops are also partially or largely exposed towards the center of the circuit boards.

This refinement also advantageously contributes to the good antenna characteristic of the novel microwave antenna and its high suitability for use in factory workshops or the like.

In a further refinement, a third conductor loop is arranged as a printed conductor track on the first printed circuit board, wherein the first and the third conductor loops lie on one plane and are offset in two directions within the plane. In preferred exemplary embodiments, the first and the third conductor loop are offset through about $\lambda/4$ laterally and through about $\lambda/2$ vertically.

This refinement integrates a second loop antenna on the first printed circuit board. Because of the offset arrangement, this refinement allows a very simple, low-cost, and compact multiple antenna for diversity operation.

In a further refinement, the novel microwave antenna has a third printed circuit board having a fourth conductor loop, wherein the third printed circuit board is attached to the first printed circuit board transversely with respect to the third conductor loop.

In this refinement, both diversity antennas are implemented in accordance with the fundamental idea of the present invention. The second and the third printed circuit boards are advantageously the same, thus allowing very simple and low-cost production. Independently of this, this refinement offers a very compact multiple antenna for advantageous diversity operation.

In a further refinement, the novel microwave antenna has an antenna switching unit which is designed to selectively connect the feed connection to the first or to the third conductor loop, wherein the antenna switching unit is arranged on the first printed circuit board.

In this refinement, an antenna switching unit for diversity operation is integrated in the microwave antenna. The integration of the antenna switching unit in the microwave antenna allows very flexible use, because no changes are required to the transmitting and receiving devices to which the novel antenna is connected.

In a further refinement, the novel microwave antenna has a reflector—preferably in the form of a plate—which is attached to the first printed circuit board.

In particular, a reflector such as this is advantageous when the novel microwave antenna is in the form of a diversity antenna with an integrated antenna switching unit, because, in this case, the reflector can advantageously shield the antenna switching unit. Furthermore, the reflector can further improve the antenna characteristic for applications in factory workshops or the like, since there is generally little use in radiated emission vertically downward, when the antenna is arranged on or directly adjacent to the device to be networked.

It is self-evident that the features mentioned above and those which are still to be explained in the following text can be used not only in the respectively stated combination but also in other combinations or on their own, without departing from the scope of the present invention.

BRIEF DESCRIPTION OF THE DRAWINGS

Exemplary embodiments of the invention will be explained in more detail in the following description, and are illustrated in the drawing, in which.

DESCRIPTION OF PREFERRED EMBODIMENTS

Figure 1:
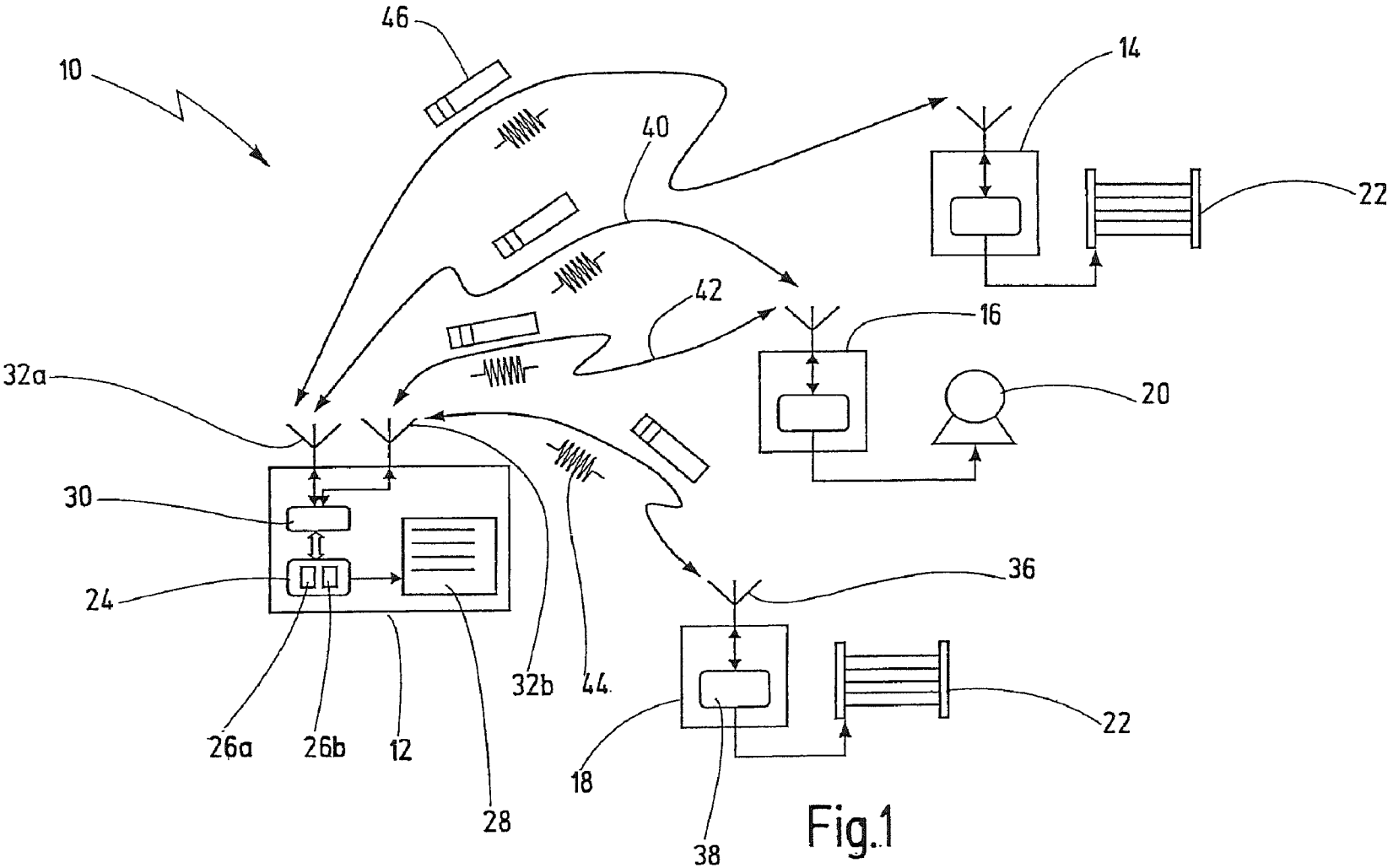
FIG. 1 shows a schematic illustration of an automated installation with microwave antennas according to one exemplary embodiment of the invention.

In FIG. 1, an installation where exemplary embodiments of the novel microwave antenna are used is designated overall with reference number 10.

The installation 10 has a control unit 12 and a plurality of remote I/O (input/output) units 14, 16, 18. An electrical drive 20 is connected to I/O unit 16. For example, this is a drive for a robot or some other machine for automatic processing of workpieces (not illustrated here). Drive 20 is supplied with electricity via I/O unit 16, and it can therefore be switched off by I/O unit 16. A light barrier 22 is connected to each of the I/O units 14 and 18. The light barriers 22 safeguard the robot or the electrical machine. The light barriers 22 are typical examples of sensors whose signal states are read by the control unit 12 in order to produce control signals, by means of which the drive 20 can be switched off.

The control unit 12 and the I/O units 14, 16, 18 together form a safety-relevant control system within the meaning of the standards EN 954-1, IEC 61508 and/or EN ISO 13849-1 in this case. In preferred exemplary embodiments, the control unit 12 and the I/O units 14, 16, 18 each are designed to be failsafe in terms of Category 3 and higher in accordance with EN 954-1. In order to achieve this, the safety-relevant parts of the control unit 12 and of the I/O units 14, 16, 18 are of redundant design, and they carry out regular functional tests in order to ensure that the drive 20 may be switched off even when a fault occurs. In particularly preferred embodiments, the control unit 12 also contains the operational control system the drive 20, that is to say the control system for the normal working movements of the robot or of the machine. In principle, the control unit 12 could also be a pure operating control system, and the safety-relevant control functions could be controlled by a further control unit (not illustrated here) which, for example, is installed in the switchgear cabinet for the robot or the machine.

In the illustrated exemplary embodiment, the control unit 12 has a signal and data processing part 24, which is of redundant design. The signal and data processing part 24 has two processors 26*a*, 26*b*, which operate redundantly with respect to one another, and monitor one another. The processors 26*a*, 26*b* can access a memory 28 in which the control program for the installation 10 is stored.

The control unit 12 furthermore has a communication interface 30, which in this case is connected to two microwave antennas 32*a*, 32*b* according to one exemplary embodiment of the invention. In a preferred exemplary embodiment, the two antennas 32*a*, 32*b* are integrated into one diversity antenna, which will be described further below with reference to FIGS. 7 and 8. The signal and data processing part 24 communicates via communication interface 30 and antennas 32*a*, 32*b* with the remote I/O units 14, 16, 18, in order to read the signal states of the sensors 22, and to output the control commands for drive 20.

Each I/O unit 14, 16, 18 has an antenna 36 and a communication interface 38. The I/O units 14, 16, 18 communicate via antenna 36 and communication interface 38 with the control unit 12, in order to transmit the sensor signals and to receive the control commands. For this purpose, the communication interfaces 30, 38 transmit and receive radio-frequency radio signals 40, 42. In one exemplary embodiment, the frequency of the radio signals 40, 42 is about 2.4 GHz. Each radio signal comprises a plurality of signal packets (so-called bursts) which follow one another in time and between which there are time pauses. Messages or data telegrams 46 are transmitted by means of the radio-frequency signal packets, in which the data to be interchanged between control unit 12 and I/O units 14, 16, 18 is coded.

FIGS. 2 to 6 show a first exemplary embodiment of the novel microwave antenna in the form of an individual antenna 36. The same reference symbols denote identical elements.

The antenna 36 has a first printed circuit board 48 and a second printed circuit board 50. A first conductor loop 52, having a first end 54 and a second end 56, is arranged on the first printed circuit board 48. As can be seen from FIGS. 3 and 5, half of the first conductor loop 52 runs on the front face 58 of the first printed circuit board 48, and the other half on the rear face 60. Plated-through areas are located in the upper area of the first printed circuit board 48, through which the first conductor loop 52 is passed from the front face 58 to the rear face 60.

A second conductor loop 64 is arranged on the second printed circuit board 50, and has a third end 66 and a fourth end 68. The ends 66, 68 of the second conductor loop 64 are passed to the rear face 74 of the second printed circuit board 50 through plated-through areas 70, 72. Apart from this, the second conductor loop 64 runs completely on the front face 76 of the second printed circuit board 50.

Figures 3, 4, 5, 6:
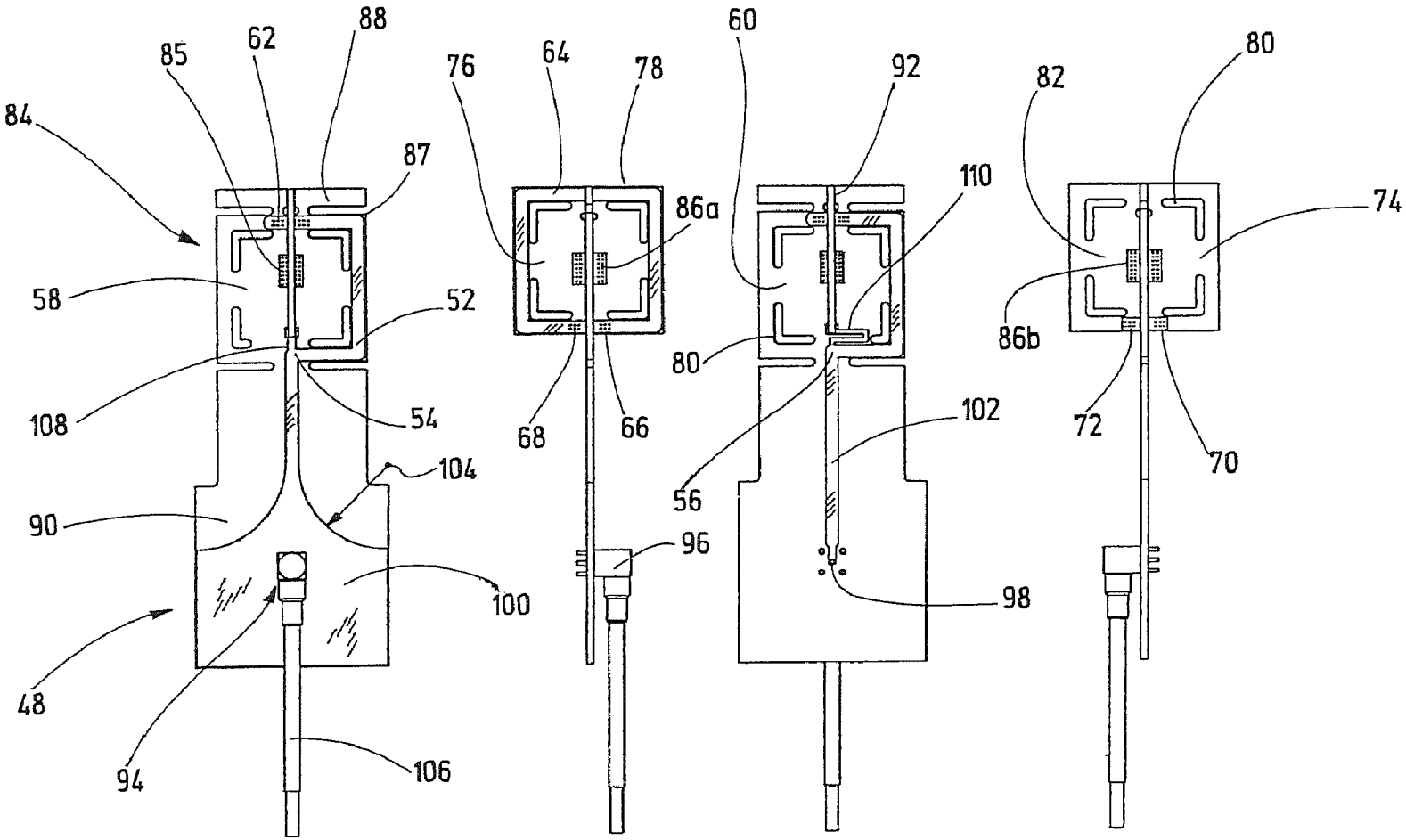
FIGS. 3-6 show four side views of the antenna of FIG. 2.

As can be seen from FIGS. 4 and 6, the second printed circuit board 50 is square, and the second conductor loop 64 runs at the edge 78 of the printed circuit board 50. Accordingly, the second conductor loop 64 is a square conductor loop in this case. The edge length is chosen such that it is approximately $\lambda/4$ of the radio waves to be transmitted or to be received. L-shaped slots 80 are arranged at the four corners of the printed circuit board 50 in such a way that the second conductor loop 64 is partially exposed toward the center of printed circuit board 50. It could also be said that the second printed circuit board 50 has an outer frame, on which the second conductor loop is arranged in the form of a conductive layer (for example composed of copper) over the entire area. Within the frame, there is a central printed circuit board area 82, which is connected to the outer frame via four webs arranged in a cruciform shape. Plated-through double-sided metal surfaces 86*a*, 86*b* are arranged in this central printed circuit board area 82. The metal surfaces 86 are isolated from the conductor loops 52, 64. They are used only as solder surfaces, where the first and second printed circuit boards 48, 50 are soldered to one another in order to produce a mechanical, robust connection.

The first printed circuit board 48 is substantially larger than the second printed circuit board 50, but has a square printed circuit board area 84 whose size is equal to that of the second printed circuit board 50. The first conductor loop 52 runs at the edge of the square printed circuit board area 84. L-shaped slots 80 are arranged on the inner face of the first conductor loop 52, by means of which the first conductor loop 52 is at least partially exposed.

The first printed circuit board 48 also has a second and a third printed circuit board area 88, 90, which are separated from the square printed circuit board area 84 with the aid of slots 87. The second printed circuit board area 88 is a relatively small strip, which is arranged above the printed circuit board area 84. The printed circuit board area 88 is essentially used to form a holder 92 in the form of a slot, into which the second printed circuit board 50 is inserted from above. The second printed circuit board 50 is held somewhat above the square printed circuit board area 84 with the aid of the printed circuit board area 88, such that the first conductor loop 52 is passed through under the second conductor loop 64.

Figure 2:
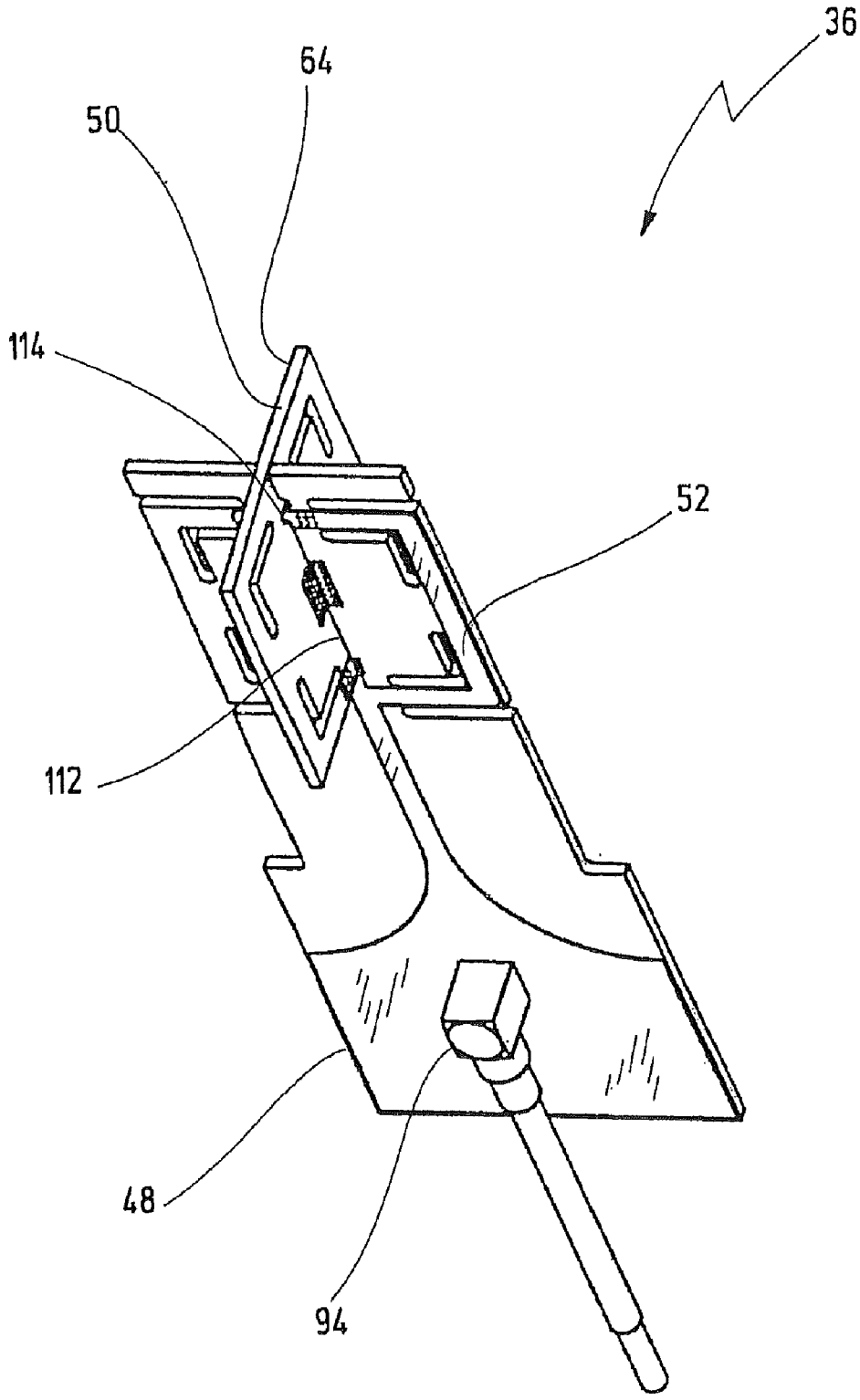
FIG. 2 shows a perspective illustration of one preferred exemplary embodiment of the novel microwave antenna.

The third printed circuit board area 90 forms the foot of the antenna 36 and is fitted with a coaxial plug 94 which forms a common feed connection for the two conductor loops 52, 64. The plug 94 is soldered on in the lower part of the printed circuit board area 90 and has an outer conductor 96 and an inner conductor 98. The outer conductor 96 is soldered to a conductor track 100, which is arranged on the front face of the third printed circuit board area 90. The inner conductor 98 is soldered to a conductor track 102 which runs on the rear face of the third printed circuit board area 90. The conductor tracks 100, 102 together form an (at least partially symmetrical) stripline, via which plug 94 is electrically connected to the first end 54 and to the second end 56 of the first conductor loop 52. As can be seen in FIGS. 2 and 3, the front conductor track 100 is wide in the area of the plug 96, and tapers symmetrically toward the first end 54. The width of the front conductor track 100 decreases with a curvature profile whose radius 104 is approximately $\lambda/6$. In contrast, the rear-face conductor track 102 has a largely constant width, apart from a short piece in the area of the plug 94, which is required for electrical connection of the inner conductor 98.

The decreasing width of the front conductor track 100 together with the rear-face conductor track 102 forms a balun, by means of which the coaxial (unbalanced) connecting line 106 of the antenna is matched to the balanced stripline, forming the front and rear-face conductor tracks 100, 102 in the area of the first and second conductor loops 52, 64.

As can be seen in FIG. 3, the first end 54 of the first conductor loop 52 and the third end 66 of the second conductor loop 64 are connected to one another virtually directly by the first end 54 and the third end 66 being soldered to one another in the plated-through area 72. Only a very short conductor track piece 108 is required here in order to compensate for the small height offset between the first and the second conductor loops 52, 64. The length of the conductor track piece 108 corresponds approximately to the width of the first conductor loop 52.

In contrast, the second end 56 and the fourth end 68 are not connected directly, but via a bypass line 110. The bypass line 110 produces a phase shift of about 90° between the first and the second conductor loops 52, 64. During transmission, this phase shift results in a transmitted wave with circular polarization, which is emitted essentially upward and downward. Furthermore, the antenna 36 is able to receive electromagnetic radio waves with different polarization directions.

As can best be seen in FIG. 2, the second printed circuit board 50 has a long slot 112 which subdivides the second printed circuit board 50 into two halves and extends over virtually the entire second printed circuit board 50. The slot 112 ends in an oval opening 114 at the upper end of the second printed circuit board 50. The slot 112 in the second printed circuit board 50 is plugged onto the first printed circuit board 48, with the remaining web of the second printed circuit board 50 above the slot 112 engaging in the holder 92, which is in the form of a slot, on the printed circuit board area 88 of the first printed circuit board 48. The printed circuit boards 48 and 50 end flush at the upper end of the antenna 36 and, in a plan view, form a symmetrical cross. The novel microwave antenna 36 is typically used such that the first printed circuit board 48 is arranged vertically and the symmetrical cross forms the upper end of the antenna 36. In preferred exemplary embodiments, the novel antenna 36 is mounted vertically on a switchgear cabinet composed of steel, or on some other metallic base body. However, the antenna 36 can also be arranged in a horizontal position, or inclined. The antenna 36 is preferably protected by a radome (not illustrated here). In preferred exemplary embodiments, each I/O unit 14, 16, 18 of the installation 10 has one such antenna 36.

Figure 8:
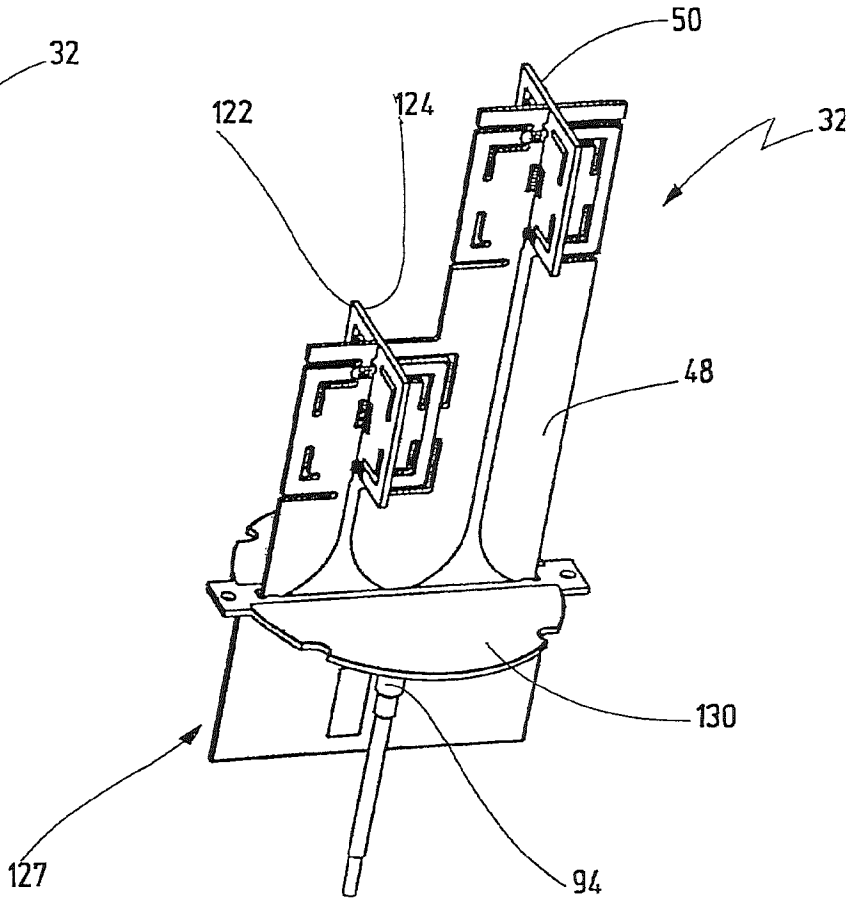
FIG. 8 shows a perspective illustration of the microwave antenna as shown in FIG. 7.
Figure 7:
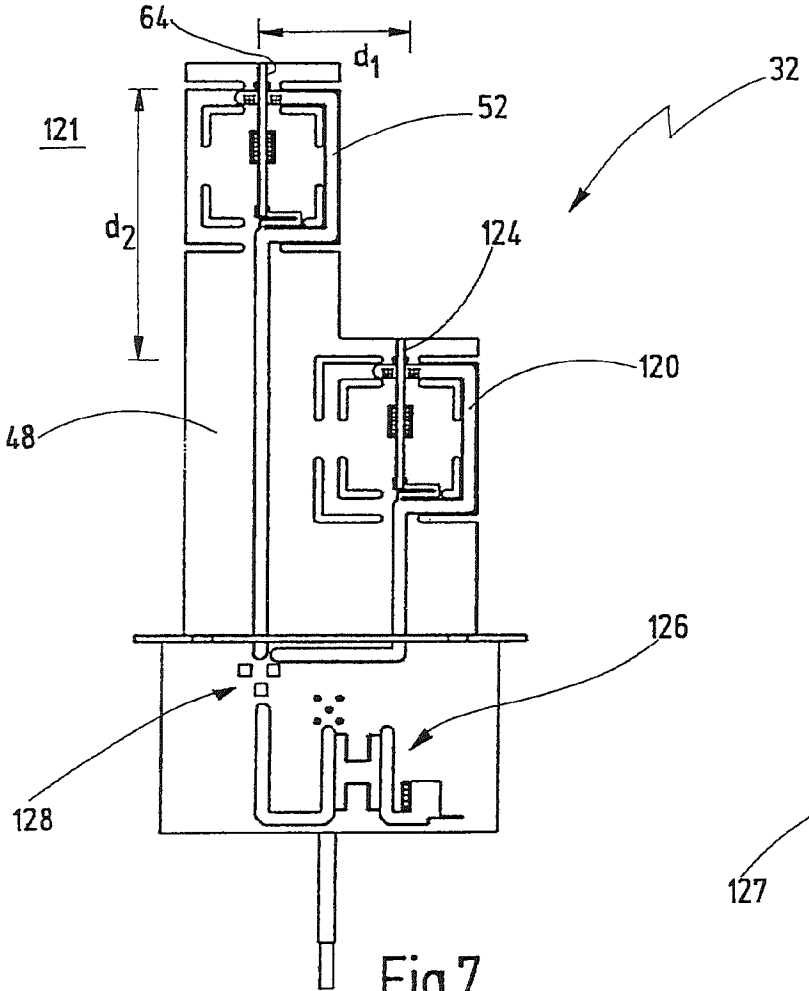
FIG. 7 shows a side view of another preferred embodiment of the novel microwave antenna.

FIGS. 7 and 8 show a preferred exemplary embodiment of diversity antenna 32 of the control unit 12. The same reference symbols denote the same elements as before.

In the antenna 32, the first printed circuit board 48 has a third conductor loop 120, which is designed in precisely the same way as the first conductor loop 52. The first conductor loop 52 and the third conductor loop 120 lie on a common plane 121. However, they are offset laterally and in height within the plane 121. The lateral distance $d_1$ is approximately $\lambda/4$. The distance $d_2$ in height is approximately $\lambda/2$.

Furthermore, a third printed circuit board 122 is plugged onto the first printed circuit board 48 in the area of the third conductor loop 120. The third printed circuit board 122 is identical to the second printed circuit board 50, and has a fourth conductor loop 124. The third conductor loop 120 and the fourth conductor loop 124 together form a second antenna 32*b*, which is offset laterally and in height with respect to the first antenna 32*a*.

Reference number 126 denotes an automatic antenna switching unit which is arranged at the lower end 127 of the first printed circuit board 48. The antenna switching unit 126 comprises semiconductor switches, such as PIN diode switches 128, by means of which the connection can be switched between the common feed connection 94 and the conductor loops 52/64 and 120/124. One preferred exemplary embodiment of the automatic switching unit 126 is described in a further patent application from the same applicant, entitled "Apparatus and method for wireless networking of automation devices", which was filed at the same time as the present application. The content of this parallel patent application is included here by reference.

Reference number 130 denotes a reflector, which is arranged transversely with respect to the first printed circuit board 48 and is attached to the first printed circuit board 48. The reflector 130 is in this case a substantially circular printed circuit board with a conductive coating. The reflector 130 is arranged between the antenna switching unit 126 and the conductor loops 52, 64, 120, 124, such that it shields the antenna switching unit 126 against the transmitted radiation from the antenna elements 32*a*, 32*b*. In principle, a reflector 130 such as this could also be used on the individual antenna 36 which is illustrated in FIGS. 2 to 6.

What is claimed is:

1. A microwave antenna for wireless interconnection of remote sensors, remote actuators and a central control unit of an automated installation, the microwave antenna being designed for transmitting or receiving radio signals having a defined wavelength and the antenna comprising:

a first printed circuit board having a front face and a rear face;

a first rectangular conductor track arranged about half on the front face and about half on the rear face, said first conductor track forming a first conductor loop having a first end on the front face and a second end on the rear face;

a second printed circuit board transversely attached to the first printed circuit board;

a second rectangular conductor track arranged on the second circuit board and forming a second conductor loop having a third end and a fourth end;

a coaxial connector secured to the first printed circuit board, the coaxial connector comprising an inner conductor and an outer conductor;

a solder connection conductively connecting the first end and the third end;

a bypass line having a length corresponding to approximately one quarter of the wavelength, the bypass line conductively connecting the second end and the fourth end; and a front conductor track on the front face and a rear-face conductor track on the rear face, wherein the front conductor track is configured to conductively connect the outer conductor and the first end, and wherein the rear-face conductor track is configured to conductively connect the inner conductor and the second end.

2. The microwave antenna of claim 1, wherein at least one of the first and second printed circuit boards defines a slot, into which the other one from the first and second printed circuit boards is inserted.

3. The microwave antenna of claim 1, wherein at least one first metal surface is arranged on the first printed circuit board, and at least one second metal surface is arranged on the second printed circuit board, wherein the first and second metal surfaces each are isolated from the first and second conductor loops, and wherein the first and second metal surfaces are directly soldered to one another.

4. A microwave antenna for wireless interconnection of remote devices of an automated installation, the microwave antenna being designed for transmitting or receiving radio signals having a defined wavelength and the antenna comprising:

a first printed circuit board comprising a first conductor loop having a first end and a second end and comprising a second conductor loop having a third end and a fourth end, the first printed circuit board defining a plane in which the first and second conductor loops are offset with respect to one another in two orthogonal directions;

a second printed circuit board transversely attached to the first printed circuit board in the vicinity of the first conductor loop, the second printed circuit board comprising a third conductor loop which is conductively connected to the first conductor loop via a bypass line having a length corresponding to approximately one quarter of the wavelength;

a third printed circuit board transversely attached to the first printed circuit board in the vicinity of the second conductor loop, the third printed circuit board comprising a fourth conductor loop which is conductively connected to the second conductor loop via a further bypass line having a length corresponding to approximately one quarter of the wavelength;

a coaxial connector secured to the first printed circuit board; and an antenna switching unit integrated on the first printed circuit board and designed to alternatively connect the coaxial connector to either the first conductor loop or the second conductor loop.

5. A microwave antenna for wireless networking of automation devices, the microwave antenna being designed for transmitting or receiving radio signals having a wavelength, said antenna comprising:

a first printed circuit board, on which a first conductor loop is arranged as a printed conductor track, the first conductor loop having a first end and a second end;

a second printed circuit board, on which a second conductor loop is arranged as a printed conductor track, the second conductor loop having a third end and a fourth end, and the second printed circuit board being arranged transversely with respect to the first printed circuit board;

a common feed connection arranged on the first printed circuit board for feeding the first and second conductor loops at the first and third ends;

a bypass line having a length corresponding to approximately one quarter of the wavelength of the radio signals, the bypass line conductively connecting the second end and the fourth end;

a third conductor loop arranged as a printed conductor track on the first printed circuit board, the first printed circuit board defining a plane where the first conductor loop and the third conductor loop are offset in two orthogonal directions; and a third printed circuit board haying a fourth conductor loop, wherein the third printed circuit board is attached to the first printed circuit board substantially parallel with respect to the second printed circuit board.

6. The microwave antenna of claim 5, wherein at least one of the first and second printed circuit boards defines a slot, into which the other one from the first and second printed circuit boards is inserted.

7. The microwave antenna of claim 5, wherein at least one first metal surface is arranged on the first printed circuit board, and at least one second metal surface is arranged on the second printed circuit board, wherein the first and second metal surfaces each are isolated from the first and second conductor loops, and wherein the first and second metal surfaces are soldered to one another.

8. The microwave antenna of claim 7, wherein each of the first and second printed circuit boards has a front face and a rear face, and wherein at least one of the first and second metal surfaces comprises a front metal surface on the front face and a rear-face metal surface on the rear face, the front metal surface and the rear-face metal surface being conductively connected by plated through holes, thereby forming a plated-through double metal surface.

9. The microwave antenna of claim 5, wherein the bypass line is a printed conductor track arranged on the first printed circuit board.

10. The microwave antenna of claim 5, wherein the first and the third ends are soldered to one another substantially directly.

11. The microwave antenna of claim 5, wherein the first printed circuit board has a front face and a rear face, and wherein the first conductor loop is arranged approximately half on the front face and approximately half on the rear face.

12. The microwave antenna of claim 5, wherein each of the conductor loops is square.

13. The microwave antenna of claim 5, wherein the first and second printed circuit boards each have an outer edge, and wherein each of the first and second conductor loops run at the outer edge.

14. The microwave antenna of claim 5, further comprising an antenna switching unit which is designed to alternatively connect the feed connection to either the first conductor loop or the third conductor loop.

15. The microwave antenna of claim 14, wherein the antenna switching unit is arranged on the first printed circuit board.

16. The microwave antenna of claim 5, wherein each conductor loop has an overall path length that is substantially equal to the wavelength.

17. A microwave antenna for wireless networking of automation devices, the microwave antenna being designed for transmitting or receiving radio signals having a wavelength, said antenna comprising:

a first printed circuit board, on which a first conductor loop is arranged as a printed conductor track, the first conductor loop having a first end and a second end;

a second printed circuit board, on which a second conductor loop is arranged as a printed conductor track, the second conductor loop having a third end and a fourth end, and the second printed circuit board being arranged transversely with respect to the first printed circuit board;

a common feed connection arranged on the first printed circuit board for feeding the first and second conductor loops at the first and third ends;

a bypass line having a length corresponding to approximately one quarter of the wavelength of the radio signals, the bypass line conductively connecting the second end and the fourth end; and a further printed feeder conductor track, which is arranged on the first printed circuit board and which conductively connects the feed connection and the first end;

wherein the first printed circuit board has a front face and a rear face, and wherein the further printed feeder conductor track comprises a front conductor track on the front face and a rear-face conductor track on the rear face, wherein the feed connection is a coaxial connection with an inner conductor and an outer conductor, wherein the front conductor track conductively connects the outer conductor and the first end, and wherein the rear-face conductor track conductively connects the inner conductor and the second end.

18. The microwave antenna of claim 17, wherein the front conductor track has a conductor track width which is broad in an area of the feed connection and which tapers symmetrically toward the first end.

* * * * *